US007266916B2

(12) United States Patent
Spiro et al.

(10) Patent No.: US 7,266,916 B2
(45) Date of Patent: Sep. 11, 2007

(54) APPARATUS FOR DISPLAYING PRINTED INFORMATION INSIDE A GOLF HOLE

(76) Inventors: Mark David Spiro, 56 Ennismore Gardens, Knightsbridge, London (GB) SW7 1AJ; Tom Heinrich Unger, 56 Ennismore Gardens, Knightsbridge, London (GB) SW7 1AJ; Noel Baden Thomas, 56 Ennismore Gardens, Knightsbridge, London (GB) SW7 1AJ ( * ) Notice: Subject to any disclaimer, the term of this patent is extended or adjusted under 35 U.S.C. 154(b) by 0 days.

(21) Appl. No.: 10/469,781

(22) PCT Filed: Mar. 4, 2002

(86) PCT No.: PCT/GB02/00882

§ 371 (c)(1),
(2), (4) Date: Feb. 27, 2004

(87) PCT Pub. No.: WO02/070078

PCT Pub. Date: Sep. 12, 2002

(65) Prior Publication Data

US 2004/0134109 A1 Jul. 15, 2004

(30) Foreign Application Priority Data

Mar. 5, 2001 (GB) ..... 0105363.6
May 30, 2001 (GB) ..... 0113035.0

(51) Int. Cl.
*A63B 57/00* (2006.01)

(52) U.S. Cl. ..... 40/606.03; 473/175

(58) Field of Classification Search ..... 40/607.13, 40/611.01, 642.01, 606.03, 660, 663; 473/175, 473/176; 403/349; 248/222.41, 221.12
See application file for complete search history.

(56) References Cited

U.S. PATENT DOCUMENTS

| | | | | |
|---|---|---|---|---|
| 1,568,321 | A | 1/1926 | Coldwell | |
| 4,878,665 | A | 11/1989 | Boudreau et al. | |
| 5,249,384 | A | 10/1993 | Dark, Jr. | |
| 5,362,044 | A | 11/1994 | Hageman | |
| 5,382,018 | A | 1/1995 | Browne | |
| 5,769,731 | A * | 6/1998 | Reimer | 473/150 |

FOREIGN PATENT DOCUMENTS

| | | |
|---|---|---|
| EP | 11233326 | 9/1999 |
| JP | 11-244436 | 3/1999 |

* cited by examiner

*Primary Examiner*—Cassandra Davis
(74) *Attorney, Agent, or Firm*—Townsend and Townsend and Crew LLP

(57) ABSTRACT

A golf hole advertising apparatus comprises a housing countersunk in ground. The housing defines a cylindrical chamber with an opening for receiving a golf ball (not shown). The apparatus further comprises an annular display disc which is configured to fit through opening into chamber. The housing and annular display disc are provided with corresponding profiles which interengage through relative axial rotation to releasably secure the annular display disc to the raised floor of the housing. The annular display disc has a pair of diametrically opposed tabs on the radially inner periphery thereof. Each tab has a drive surface—which is accessible through opening—for transmitting applied torque to the annular display disc to engage/disengage the profiles.

7 Claims, 2 Drawing Sheets

APPARATUS FOR DISPLAYING PRINTED INFORMATION INSIDE A GOLF HOLE

CROSS-REFERENCES TO RELATED APPLICATIONS

This application is a National Phase Application of PCT/GB02/00882, entitled "APPARATUS FOR DISPLAYING PRINTED INFORMATION INSIDE A GOLF HOLE," filed on Mar. 4, 2002, which claims the benefit of the filing date of GB Patent Application No. 0105363.6, filed Mar. 5, 2001, and GB Patent Application No. 0113035.0, filed May 30, 2001.

BACKGROUND OF THE INVENTION

FIG. 1 shows a golf hole advertising apparatus (10) comprising a housing (12) countersunk in ground (14). The housing (12) defines a cylindrical chamber (16) with an opening (18) for receiving a golf ball (not shown). The apparatus (10) further comprises an annular display disc (20) which is configured to fit through opening (18) into chamber (16). The housing (12) and annular display disc (20) are provided with corresponding profiles (22,24) which interengage through relative axial rotation to releasably secure the annular display disc (20) to the raised floor (26) of the housing (12). The annular display disc (20) has a pair of diametrically opposed tabs (28) on the radially inner periphery (30) thereof. Each tab has drive surfaces (32,33) extending in an axial and radial direction—which are accessible through opening (18)—for transmitting applied torque to the annular display disc (20) when engaging and thereafter disengaging the corresponding profiles (22,24).

Various different devices are known from the prior art for displaying an advertisement in a golf hole. For example, U.S. patent specification U.S. Pat. No. 4,878,665 describes a device comprising a removable insert in the form of an annular disc which is secured to a raised floor in a housing, hereinafter referred to as a golf cup. The radially inner periphery of the annular disc includes tabs which in use engage in slots in the raised floor of the golf cup. The tabs and slots are configured to provide an interlocking action in the manner of a bayonet fixing. For another example, U.S. patent specification U.S. Pat. No. 5,249,384 describes a device comprising an annular disc insert which is formed in two parts to provide an annular cavity for receiving an annular sheet of printed advertising material. The annular disc has lugs which engage with a snap-fit action apertures in the raised floor of the golf cup.

The present applicant has recognised that there are disadvantages associated with known designs of golf cup advertising devices. For example, green keepers have encountered difficulties in removing the annular discs from the golf cups, either for routine cleaning purposes or when replacing the advertisement. In some cases, the golf cup has to be removed from the ground in order for an ejecting force to be applied to the underside of the annular disc. Also, in some cases, the tabs and lugs providing the locking action between the annular disc and the golf cup have broken, perhaps as a result of too much force being applied during annular disc insertion/removal. Such difficulties mean there is reluctance amongst green keepers and the like to use, or at least maintain, the annular disc insert in the golf cups.

BRIEF SUMMARY OF THE INVENTION

In accordance with the present invention, there is provided apparatus for displaying information inside a golf hole, comprising: a housing which defines a chamber with an opening for receiving a golf ball; and an annular display disc configured to fit inside the chamber, the housing and annular display disc having corresponding profiles which releasably interengage through relative axial rotation, characterised in that the annular display disc has at least one drive surface extending in an axial direction for transmitting applied torque to the annular display disc, the at least one drive surface being accessible through the chamber opening when the corresponding profiles are interengaged.

By providing the at least one drive surface, removal of the annular display disc from the housing (i.e. golf cup) is much easier than hitherto before, even when the housing is countersunk in the ground. Being accessible through the chamber opening, the drive surface(s) provide a feature which allows torque to be transmitted to the annular display disc by a tool or the like inserted into the chamber from above the opening. Such torque may be used to secure the annular display disc in the chamber, and thereafter to release it. Accordingly, the green keeper no longer has to lift the housing from the ground in order to replace the annular display disc.

The at least one drive surface may form part of the radially inner periphery of the annular display disc. In this way, the drive surface(s) does not encroach upon the display face of the annular display disc. In one embodiment, the annular display disc may have a pair of drive surfaces, perhaps diametrically opposed.

The corresponding profiles on the housing and annular display disc may releasably interengage through a combination of axial and rotational movement. For example, the profiles may interengage with a bayonet-fixing action. One profile may comprise a pin with an enlarged head, the pin being aligned in an axial direction when engaging a corresponding profile. The corresponding profile may comprise a slotted aperture having a first portion through which the enlarged head readily fits, and a second portion which is too small for the head to pass through. Thus, once the pin is inserted axially into the first portion of the slotted aperture and twisted axially into the second portion, the enlarged head prevents the pin from being removed axially.

The apparatus may further comprise a tool for applying torque to the annular display disc, the tool being configured to engage the at least one drive surface through the chamber opening. For example, the radially inner periphery of the annular display disc may have flats providing a plurality of drive surfaces. The tool may have a shaft with a cross section which engages the flats such that rotation of the shaft applies torque to the annular display disc through the flats.

The apparatus may include means for releasably coupling the tool to the annular display disc when positioning the annular display disc in the chamber. The coupling means may comprise a pair of mateable connectors, with one connector associated with the tool and the other connector associated with the annular display disc. The connector associated with the annular display disc may provide the at least one drive surface. For example, one connector may comprise a tab-like member and the other connector may comprise a groove configured to slidingly receive the tab-like member when the tool axially engages the annular display disc. The groove may have means to retain the tab-like member therein. For example, the groove may be substantially L-shaped. In use, opposed faces of the tab-like member and the groove will abut each other as torque applied to the tool is transmitted to the annular display disc. Thus, one such opposed face associated with the annular display disc will form the aforementioned drive surface.

The mateable connectors may provide a connection therebetween which resists axial separation when the annular display disc is releasably interengaged in the housing. In this way, the tool may be used to lift the housing and annular display disc as one assembly from a hole in the ground. This may be of great assistance to a greenkeeper when changing the position of the golf hole on the green—something which usually occurs several times per week.

The apparatus may further comprise a printed display member for fixing onto the annular display disc. The printed display member may comprise a printed layer covered by a resilient, transparent coating. Such a coating may be scratch resistant, at least to the extent of resisting surface damage caused by insertion/removal of a flag pole associated with the golf hole. The transparent coating may comprise a plasticized lacquer which retains the ability to flow to repair minor surface indentations. The printed display member may include adhesive underneath the printed layer for adhering the member to the annular display disc.

BRIEF DESCRIPTION OF THE DRAWINGS

An embodiment of the invention will now be described by way of example, with reference to the accompanying Figures in which.

DETAILED DESCRIPTION OF THE INVENTION

Figure 1:
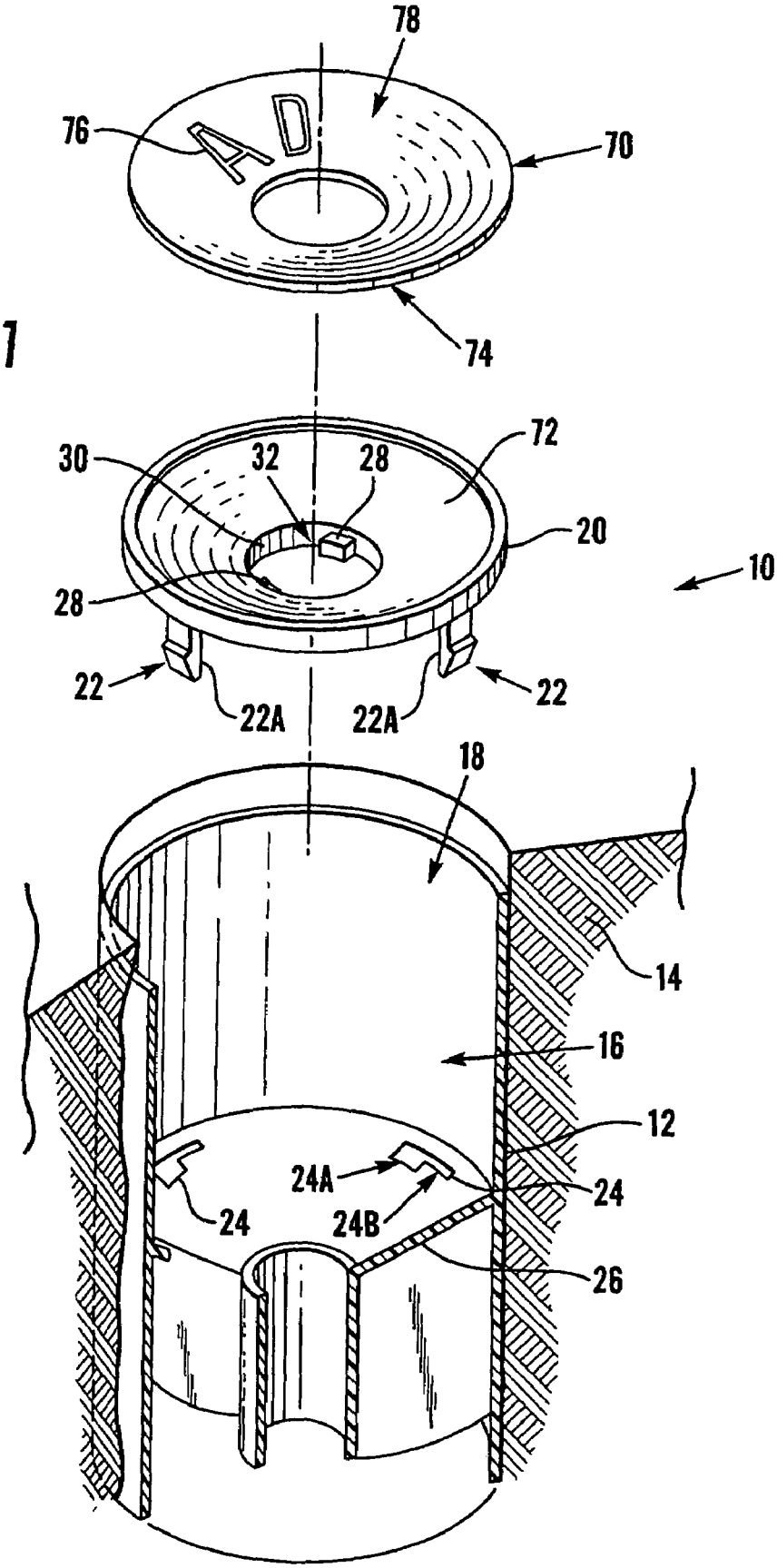
FIG. 1 is a cut-away, exploded perspective view showing apparatus embodying the present invention.

FIG. 1 shows a golf hole advertising apparatus (10) comprising a housing (12) countersunk in ground (14). The housing (12) defines a cylindrical chamber (16) with an opening (18) for receiving a golf ball (not shown). The apparatus (10) further comprises an annular display disc (20) which is configured to fit through opening (18) into chamber (16). The housing (12) and annular display disc (20) are provided with corresponding profiles (22,24) which interengage through relative axial rotation to releasably secure the annular display disc (20) to the raised floor (26) of the housing (12). The annular display disc (20) has a pair of diametrically opposed tabs (28) on the radially inner periphery (30) thereof. Each tab has a drive surface (32)—which is accessible through opening (18)—for transmitting applied torque to the annular display disc (20).

The housing (12) includes a support (30) extending through raised floor (26) for supporting a flagpole marking the position of the golf hole. The raised floor (26) includes slotted apertures (24) for receiving pins (22) depending from the underside of annular display disc (20). Each slotted aperture (24) has a relatively wide portion (24*a*) and a relatively narrow portion (24*b*). Each pin (22) has an enlarged head (22*a*) which is configured to fit through the relatively wide portion (24*a*) of one of the slotted apertures (24), but not the relatively narrow portion (24*b*). Axial rotation of the annular display disc (20) relative to the housing (12) will move each pin (22) from the wide portion (24*a*) to the narrow portion (24*b*), such that the head (22*a*) becomes flat under the raised floor (26), thereby securing the housing (12) of the annular display disc (20).

Figure 2:
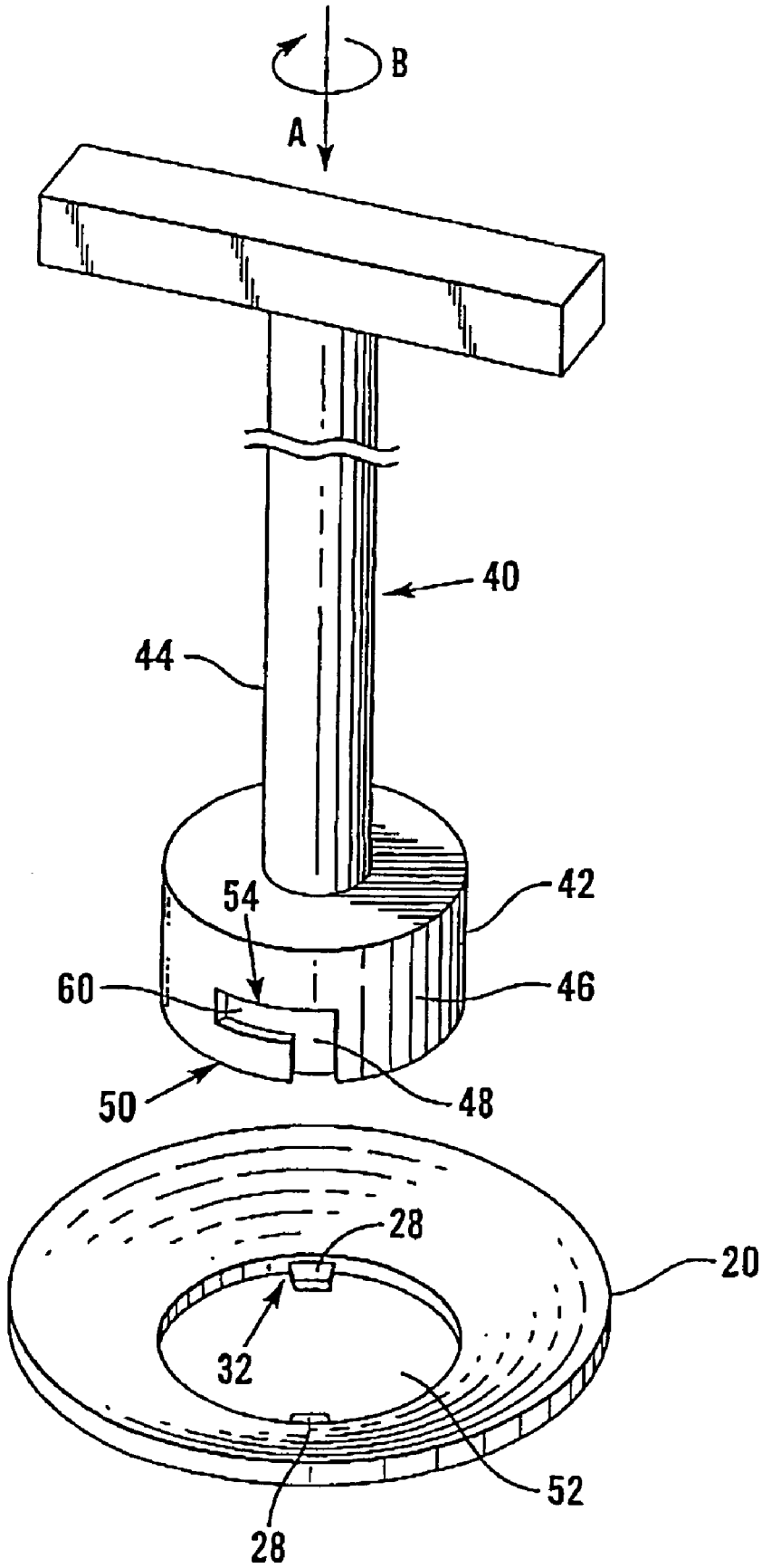
FIG. 2 is a schematic illustration showing a tool in use with an annular display disc of the apparatus of FIG. 1.

As shown in FIG. 2, a tool (40) is provided to apply torque to the annular display disc (20). Tool (40) has a drum head (42) on a shaft (44). The drum head (42) has on its curved periphery (46) a pair of diametrically opposed, blind grooves (48) extending axially from leading end (50). When the grooves (48) are aligned with the tabs (28), the head (42) may be inserted (direction arrow A) into the central opening (52) of the annular display disc (20) until the tabs (28) abut the axial end (54) of the blind grooves (48). At this point, clockwise rotation (direction arrow B) of the tool (40) will cause the torque to be applied to the annular display disc (20) through drive surface (32) of each tab (28). Such a torque will enable pins (22) to fully engage slotted apertures (24).

The tool (40) and annular display disc (20) may be releasably coupled together to facilitate insertion into the chamber (16). By extending grooves (48) circumferentially to form circumferential grooves (60), the tabs (28) and resulting "L-shaped" grooves (48, 60) form mateable connectors which couple together with a bayonet-fixing section. Once mated, with the tabs (28) located in the circumferential groove (60), the annular display disc (20) may be lowered into the chamber (60) coupled to the end of tool (40). Once the pins (22) are pushed through the slotted apertures (24), the tool (40) is rotated clockwise initially causing the tabs (28) to leave circumferential grooves and abut side walling of axial groove (48). Continued clockwise rotation of the tool (40) will cause the torque to be applied to the annular display (20) as hereinbefore described.

The tool (40) may also be used to lift the golf hole advertising apparatus (10) from the ground. When the annular disc (20) is coupled securely to the housing (12), the tool (40) can be inserted so that the tabs (28) are located in the circumferential groove (60). At this point, pulling the tool (40) upwards, directly away from the ground (14), will lift the whole apparatus (10) from the ground.

A printed display member (70) is provided which is affixed to the upper face (72) of annular display disc (20) using conventional adhesive. The printed display member (70) comprises a printed substrate layer (74) displaying indicia (76) in the form of a message or advert, and a protective transparent overcoating layer (78). The protective layer (78) comprises a thick (e.g. domed) plasticized lacquer which resists scratches and helps extend the life of the printed layer.

The invention claimed is:

1. Apparatus for displaying information inside a golf hole, comprising:

a housing which defines a chamber with an opening for receiving a golf ball; and an annular display disc configured to fit inside the chamber, the housing and annular display disc having corresponding profiles which releasably interengage through relative axial rotation, wherein the annular display disc has on its radially inner periphery at least one drive surfaces, extending in an axial and radial direction for transmitting applied torque to the annular display disc when engaging and thereafter disengaging the corresponding profiles, the at least one drive surfaces being accessible through the chamber opening when the corresponding profiles are interengaged;

wherein the corresponding profiles releasably interengage through a combination of relative axial and rotational movement; and wherein one part of the corresponding profiles comprises a pin with an enlarged head, the pin extending in an axial direction.

2. Apparatus according to claim 1, in which the corresponding profiles interengage with a bayonet-fixing action.

3. Apparatus according to claim 1, in which another part of the corresponding profiles comprises a slotted aperture having a portion through which the enlarged head fits and a second portion through which the enlarged head does not fit.

4. Apparatus for displaying information inside a golf hole, comprising:

a housing which defines a chamber with an opening for receiving a golf ball; and an annular display disc configured to fit inside the chamber, the housing and annular display disc having corresponding profiles which releasably interengage through relative axial rotation, wherein the annular display disc has on its radially inner periphery at least one drive surfaces, extending in an axial and radial direction for transmitting applied torque to the annular display disc when engaging and thereafter disengaging the corresponding profiles, the at least one drive surfaces being accessible through the chamber opening when the corresponding profiles are interengaged; and a tool for applying torque to the annular display disc, the tool being configured to engage the at least one drive surface through the chamber opening; and means for releasably coupling the tool to the annular display disc for moving the annular display disc in and out of the chamber.

5. Apparatus according to claim 4, in which the coupling means comprises a pair of mating connectors, with one connector being associated with the tool end, the other being associated with the annular display disc.

6. Apparatus according to claim 5, in which the connector associated with the annular display disc provides the at least one drive surface.

7. Apparatus according to claim 5, in which the pair of mating connectors are configured to resist axial separation when interconnected, with such interconnection of the mating connectors enabling the housing to be lifted by the tool with the annular display disc when corresponding profiles of the housing and the annular display disc are releasably interengaged.

* * * * *